US005141383A

United States Patent [19]

Phillips et al.

[11] Patent Number: 5,141,383

[45] Date of Patent: Aug. 25, 1992

[54] GOLF BALL RETRIEVER

[76] Inventors: Avon G. Phillips, 715 Formosa Rd., Gumdale, Brisbane, Queensland; Milan P. Tucek, P.O. Box 995, Capalaba, 4157 Queensland, both of Australia

[21] Appl. No.: 678,738

[22] Filed: Apr. 1, 1991

Related U.S. Application Data

[63] Continuation-in-part of Ser. No. 442,348, Sep. 20, 1989, abandoned.

[30] Foreign Application Priority Data

Mar. 20, 1987 [AU] Australia ..... PI0982

[51] Int. Cl.[5] ..... B60P 1/00

[52] U.S. Cl. ..... 414/440; 414/507; 56/328.1

[58] Field of Search ..... 56/328.1; 414/338, 434, 414/437, 438, 439, 440, 467, 501, 507

[56] References Cited

U.S. PATENT DOCUMENTS

| | | | |
|---|---|---|---|
| 2,365,540 | 12/1944 | Fonken | 414/440 |
| 2,413,679 | 1/1947 | Binder | 414/440 |
| 2,605,005 | 7/1952 | Wenzel et al. | 414/440 |
| 2,656,061 | 10/1953 | Lockie | 414/440 |
| 2,658,637 | 11/1953 | Bailey | 414/440 |
| 2,718,745 | 9/1955 | Scafidi | 56/328.1 |
| 2,735,562 | 2/1956 | Kazanjian | 414/434 |
| 2,792,955 | 5/1957 | Summer | 414/440 |
| 2,812,871 | 11/1957 | Woodall | 414/440 |
| 3,102,647 | 9/1963 | Bonney | 414/440 |
| 3,175,714 | 3/1965 | Wittek | 414/440 |
| 3,613,341 | 10/1971 | Reeves | 56/328.1 |
| 3,664,532 | 5/1972 | Gustafson | 414/440 |
| 3,748,838 | 7/1973 | Woodfill | 414/440 X |
| 3,784,037 | 1/1974 | Woodall | 414/440 |
| 3,823,838 | 7/1974 | Gustafson et al. | 414/440 |
| 3,995,759 | 12/1976 | Hollrock et al. | 414/440 |
| 4,077,194 | 3/1978 | Livingston | 56/328.1 |
| 4,157,141 | 6/1979 | Ryan | 414/440 |
| 4,158,418 | 6/1979 | Hayashi | 414/440 |
| 4,792,271 | 12/1988 | Akel | 414/507 X |

FOREIGN PATENT DOCUMENTS

| | | | |
|---|---|---|---|
| 7835341 | 12/1978 | France | 414/434 |

*Primary Examiner*—David A. Bucci
*Assistant Examiner*—James Keenan
*Attorney, Agent, or Firm*—Renner, Otto, Boisselle & Sklar

[57] ABSTRACT

A golf ball retrieving assembly to retrieve golf balls distributed over a ground surface comprises a collector wheel having a recess to accept and retain golf balls therein and at least one ball deflecting assembly moveable over the ground surface to deflect golf balls to the collector wheel. The collector wheel and the golf ball deflecting assembly are coupled to a support in such a fashion that each can track undulations in the ground surface independently of each other. A number of such golf ball retrieving assemblies can be axially positioned on a common frame member to allow large areas to be treated. By having the collector wheel and golf ball deflecting assembly able to track undulations independently of each other, golf balls can be collected from pockets and depressions in a fairway in an effective manner.

25 Claims, 7 Drawing Sheets

GOLF BALL RETRIEVER

RELATED APPLICATIONS

This application is a continuation in part of my earlier U.S. application Ser. No. 442,348 filed on the Sep. 20, 1989 as a national phase of PCT/AU88/00073.

BACKGROUND OF THE INVENTION

This invention relates to a golf ball retrieving assembly and to an apparatus containing a plurality of such golf ball retrieving assemblies in a side by side relationship.

To facilitate collection of a large number or golf balls from a fairway, it is known to use golf ball retrievers.

One type of golf ball retriever utilises a number of spaced discs mounted onto a common shaft. The spacing of the discs corresponds to the width of a golf ball whereby as the discs move over a ground surface, golf balls are caught between adjacent discs. The golf balls are subsequently dislodged by a dislodging finger and are transferred to a collecting basket. The discs can either be ground engaging or can be mounted to a common shaft which terminates with a pair of ground engaging wheels to space the discs slightly above the ground surface. Devices of this type are disclosed in the following U.S. Pat. Nos.: 3,995,759 (Hollrock), 3,823,838 (Gustafsson), 3,75,714 (Wittik), 2,792,955 (Sumner) and 2,365,540 (Fonken), and 4,792,271 (Akel).

Such retrievers suffer from a number of disadvantages. Firstly, to pink up golf balls the discs must be relatively loosely spared and to allow efficient retrieving of golf balls from a fairway, a large number of discs are required spared along a shaft. This increases the overall cost of the apparatus and increases its weight and therefore makes it unsuitable for use on certain fairways.

To overcome the above disadvantages, golf ball retrievers have been developed comprising a number of spaced collector wheels mounted to a common shaft with golf ball deflecting members being located between adjacent collector wheels to deflect golf balls towards a respective collector wheel. This obviated the requirement for a large number of discs or collector wheels to be present on the retriever as the deflector members would channel golf balls to a respective collector wheel. Examples of this type of retriever are found in the following U.S. Pat. Nos.: 2,658,637 (Bailey), 3,784,037 (Woodall), 2,812,871 (Woodall), 4,158,418 (Hayasahi) and 2,656,061 (Lockie).

A disadvantage with both of the abovementioned known types of retrievers is that the discs or wheels are mounted to a common shaft which means that the discs or collector wheels are suitable oily on relatively level surfaces and cannot track undulations in the ground surface.

For instance, golf balls tend to collect within small depressions or pockets within a fairway and the retrievers described above are not generally capable of entering into a pocket or depression to collect the golf ball but instead merely pass over the pocket or depression.

U.S. Pat. No. 2,605,005 (Wenzel) attempts to overcome the abovementioned disadvantage by providing a number of spaced collector wheels which are independently pivotly mounted to a cross bar. This allows each individual collector to track undulations in a ground surface independent of each other collector wheel. Guide members are spaced between collector wheels to guide golf balls to a respective collector wheel for retrieval.

A serious disadvantage with the Wenzel retriever is that the guide arms are rigidly attached to the retriever and are not able to track undulations in the surface independently of its respective collector wheel. As a consequence, the guide members tend to dig into the fairway surface when passing through an undulation or pockets which results in damage to the fairway, damage to the retrieving device, and clogging of the collector wheels with dirt and debris.

A similar disadvantage is found with golf ball retrievers having collector wheels spaced along a common axle and deflector members located between adjacent collector wheels although in the latter situation, the deflectors do not generally get damaged or dig into the fairway surface as these retrievers are not able to collect balls from pockets or depressions in a fairway.

Other retrievers are found in U.S. Pat. Nos. 4,157,141 (Ryan) (utilising a mat systems), 3,102,647 (Bonney), French patent 2443-851 (utilising a paddle assembly) and U.S. Pat. No. 2,413,679 (Binder).

It is an object of the invention to provide a golf ball retriever which can overcome the abovementioned disadvantages by providing a collector wheel and a ball deflecting assembly adjacent the collector wheel to guide balls towards the collector wheel and wherein the collector wheel and ball deflecting assembly can both track undulations in a ground surface and can do so independently of each other.

It is a further object of the invention to provide an apparatus comprising a number of golf ball retrieving assemblies spaced in a side by side relationship, each assembly having a collector wheel and a ball deflecting assembly which can track undulations in the ground surface independently of each other.

BRIEF SUMMARY OF THE INVENTION

This invention relates to a golf ball retrieving assembly moveable across a ground surface and comprising a ground engageable collector wheel rotatably mounted to a wheel support arm and able to track undulations in the ground surface upon movement of the assembly along the ground surface in a forward direction, said collector wheel having a recess to accept and retain golf balls therein, ball expelling means to remove golf balls from the recess and at least one ball deflecting assembly disposed adjacent the collector wheel, said ball deflecting assembly including a ground engageable and traversable member to support the ball deflecting assembly from the ground surface and to allow the ball deflecting assembly to move along the ground surface and a deflecting face located forward of the collector wheel to guide golf balls to the recess, said golf ball deflecting assembly being able to track undulations in the ground surface independently of the collector wheel.

For small areas such as putting greens or around putting greens, a single golf ball retrieving assembly according to the invention can be utilised and which may be coupled to a support such as a tow bar or trailer arm. For fairways and larger areas, a plurality of such golf ball retrieving assemblies may be mounted in a side by side relationship to a transversely extending support member.

The wheel support arm may be moveably coupled to a support such as a transversely extending support member or tow bar to allow the collector wheel to track undulations in the ground surface. In a preferred embodiment, the wheel support arm is pivotally coupled to the support. However, other forms of couplings are possible. For instance, the wheel support arm may extend substantially vertically from the collector wheel and may be spring mounted to a horizontally extending frame member. Hydraulic or pneumatic dampers may also be used to spring mount the vertically extending wheel support arm.

The ground engageable collector wheel is preferably mounted to a shaft extending from the wheel support arm. Suitably, the wheel support arm comprises a pair of spaced arm members extending along sides of the collector wheel with the shaft extending between the members and through the collector wheel.

The recess in the collector wheel preferably comprises a peripheral channel extending about the wheel. The peripheral channel may include side walls which can be resilient to enable a golf ball to be accepted and retained between the side walls. It is preferred that the collector wheel including the peripheral channel is formed from a unitary plastics or rubber material.

Alternatively, the collector wheel may include a non-resilient peripheral channel. In this alternative, the channel may be provided with grip enhancing means to enable the channel to accept and retain golf balls therein. The grip enhancing means may be in the form of an inner sleeve or a removable tire which may inserted into the channel.

The at least one ball defecting assembly is preferably secured adjacent one end of an assembly support arm. The other end of the assembly support can be pivotally mounted to a support member.

The ball deflecting assembly is preferably biased into engagement with the ground surface to ensure good tracking of the ball deflecting assembly along the ground surface. The biasing may be in the form of a spring which can be located between the support member and the assembly support arm. Alternatively, the ball deflecting assembly may be suitably weighted to ensure adequate tracking along the ground surface.

The ball deflecting assembly suitably includes a body portion disposed adjacent a side of the collector wheel. The body portion may include at least one side wall and a deflecting face.

The ground engageable and transversible member in a preferred embodiment comprises a wheel or roller but may alternatively comprise an endless belt or a slide member which can slide along the ground surface.

The wheel or roller may be rotatably mounted to a shaft which is suitably supported by the body portion and may extend between a pair of spaced side walls of the body portion.

The deflecting face can be inclined and preferably extends from adjacent the recess in the collector wheel to guide golf balls towards the recess. The deflector face preferably comprises a first inclined portion to deflect and guide golf balls to the collector wheel and a second inclined portion to deflect and guide golf balls to an adjacent collector wheel. Thus, the deflector face may have a substantially "arrow head" type configuration.

If a single golf ball retrieving assembly is used, a pair of ball deflecting assemblies can be located adjacent opposed sides of the collector wheel. The pair of ball deflecting assemblies may be inter-connected by a guide plate to further facilitate movement of golf balls to the collector wheel.

The ball expelling means preferably comprises a finger extending into the recess of the collector wheel to dislodge balls therefrom. The finger may be located adjacent an upper portion of the wheel. Suitably, the finger extends from a ball guide member to guide balls to a collecting area. The ball guide member may comprise an elongate channel section extending between the collector wheel and the collecting area. The channel section is suitably mounted to the wheel support arm.

To retrieve golf balls from large areas, it is preferred to have a number of golf ball retrieving assemblies mounted in a side by side relationship. In this arrangement, the plurality of golf ball retrieving assemblies can be mounted to a transversely extending support or frame member.

Adjacent assemblies may be spaced apart such that the spacing between adjacent collector wheels corresponds to the width of the deflecting face of a respective ball deflecting assembly. This prevents golf balls from passing between adjacent retrieving assemblies.

Each collector wheel suitably includes a pair of ball deflecting assemblies disposed adjacent each side of the collector wheel. In this arrangement, it is preferred that the deflecting face of the ball deflecting assembly has a first inclined portion to guide golf balls to one collector wheel and a second inclined face to guide golf balls to a second adjacent collector wheel.

The transversely extending support or frame member may comprise part of a main frame assembly which can be towed by a towing vehicle or alternatively may be self-propelled.

The main frame assembly suitably comprises a forward transversely extending frame member spaced from the support member. The main frame assembly can include a number of ground engaging wheels to allow the main frame assembly to be towed or propelled along a ground surface.

Golf ball collecting areas are suitably located between the forward transversely extending frame member and the support member and may comprise baskets or containers. The baskets or containers may be of sufficient size to allow one or more golf ball retrieving assemblies to transfer golf balls to a single container.

The main frame assembly may be provided with couplings to allow a number of similar frame assemblies to be coupled together in a side by side relationship thereby allowing large areas of a fairway to be treated.

BRIEF DESCRIPTION OF THE DRAWINGS

The invention will be better understood by reference to the following description of preferred embodiments thereof as illustrated in the accompanying drawings in which.

DETAILED DESCRIPTION OF THE INVENTION

Figure 1:
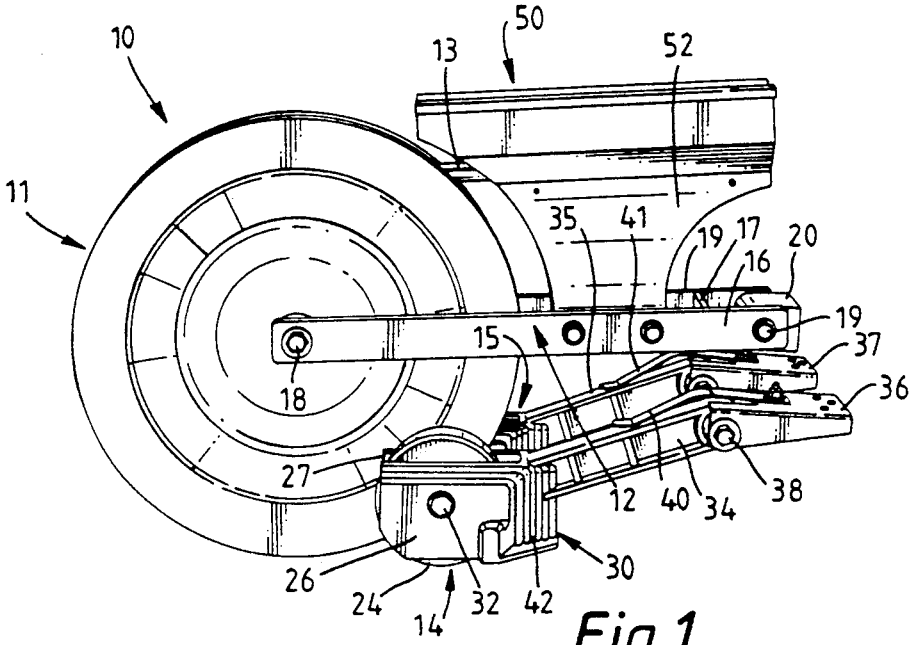
FIG. 1 is a view of a golf ball retrieving assembly according to an embodiment of the invention.
Figure 2:
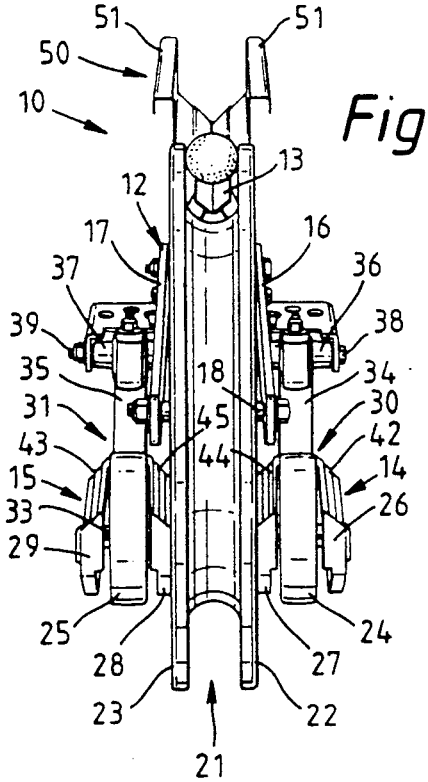
FIG. 2 is a rear view of the assembly of FIG. 1.

Referring to FIGS. 1 and 2 there is disclosed a golf ball retrieving assembly 10 according to a first embodiment of the invention. The golf ball retrieving assembly comprises a ground engageable collector wheel 11 mounted to a wheel support arm 12. The assembly further includes a ball expelling means 13 and a pair of ball deflecting assemblies 14, 15.

The ground engageable collector wheel 11 is rotatably mounted to wheel support arm 12. Wheel support arm 12 comprises a pair of spaced arm members 6, 7 which extend along respective sides of collector wheel 11. A shaft 18 extends between arm member 16 and 17 adjacent one end of the arm members and collector wheel is rotatably mounted to shaft 18. Struts 19 extend between arm member 16 and 17 to provide rigidity thereto.

The other end of each of arm members 16 and 17 is pivotly mounted about pivot pin 19 to a support 20 which may form part of or be secured to a transversely extending support member (not shown) which will be described in more detail below.

Referring to FIG. 2, there is disclosed in greater detail the recess on collector wheel 11. Recess 21 comprises a peripheral channel extending about collector wheel 11. The channel is defined by spaced side walls 22, 23, the spacing between the side walls corresponding to the width of a golf ball. Collector wheel 11 in the embodiment is formed from a unitary plastics materials and side walls 22, 23 are resiliently deformable to be able to grip a golf ball therebetween.

Ball deflecting assemblies 14, 15 are positioned adjacent the sides of collector wheel 11. Each ball deflecting assembly includes a ground engageable and transversable member in the form of a wheel 24, 25. The ball deflecting assembly further comprises a body portion formed from a pair of side walls 26, 27, 28, 29 and a deflecting face 30, 31.

Wheels 24, 25 are rotatably mounted to respective shafts 32, 33 which extend between pairs of opposed side walls 26, 27, and 28, 29.

Each of ball deflecting assemblies 14, 15 is secured to one end of an assembly support arm 34, 35 and in the embodiment, assembly support arm and ball deflecting assembly are integrally formed. The other end of each assembly support arm 34, 35 is pivotally mounted to a support 36, 37 through pivot pin 38, 39. Support 36, 37 can be secured to a transversely extending support member.

Each ball deflecting assembly is biased into contact with the ground surface by a leaf spring 40, 41. Leaf springs 40, 41 are affixed at one end to a respective support 36, 37 suitably by bolts. The other end of each leaf spring 40, 41 contacts a respective assembly support arm 34, 35 to bias the arm and therefore the ball deflecting assembly towards to ground. The ensures adequate tracking of the ball deflecting assembly along the ground surface.

The deflecting face 30, 31 on each ball deflecting assembly is of an "arrow head" configuration and includes first inclined portion 42, 43, and a second inclined portion 44, 45. The second inclined portions 44, 45 are inclined towards collector wheel 11 and function to guide golf balls towards the collector wheel.

The first inclined portions extend away from the collector wheel and function to guide golf balls to an adjacent collector wheel (if present). The deflecting face on each ball deflecting assembly is ribbed to facilitate movement of the golf ball to the collector wheel.

The ball expelling means 13 comprises an extending finger which locates within peripheral channel 21. Extending finger extends from a ball guide member 50 and is integrally formed therewith. Ball guide member 50 comprises a metallic channel section having outwardly turned flanges 51. The ball guide member 50 includes a pair of lower web members 52 (only one shown in FIG. 1) which mount the ball guide member to each of arm members 34, 35, suitably through bolts. Ball expelling means 13 locates within peripheral channel 21 at an upper portion of collector wheel 11 to dislodge golf balls therefrom and to pass golf balls along ball guide 50 and to a collecting area (see FIG. 7).

The operation of the golf ball retrieving assembly will now be described. The assembly can be mounted to a support or a trailer hitch to allow it to be towed behind a vehicle. As collector wheel 11 contacts a golf ball, resilient side walls 22, 23 will slightly expand to wedge the golf ball therebetween. The golf ball will thereafter be carried around collector wheel as it rotates and will contact ball expelling means 13. Rotation of collector wheel 11 will provide a golf ball with a forward motion as it is dislodged by expelling means 13 which will propel it through ball guide member 50 and to a collection area. Deflecting faces 30, 31 will deflect golf balls to a respective collector wheel. By having the collector wheel and each ball deflecting assembly individually pivotly mounted relative to each other, the assembly can track over undulations and through pockets or depressions to collect golf balls therefrom.

Figure 3:
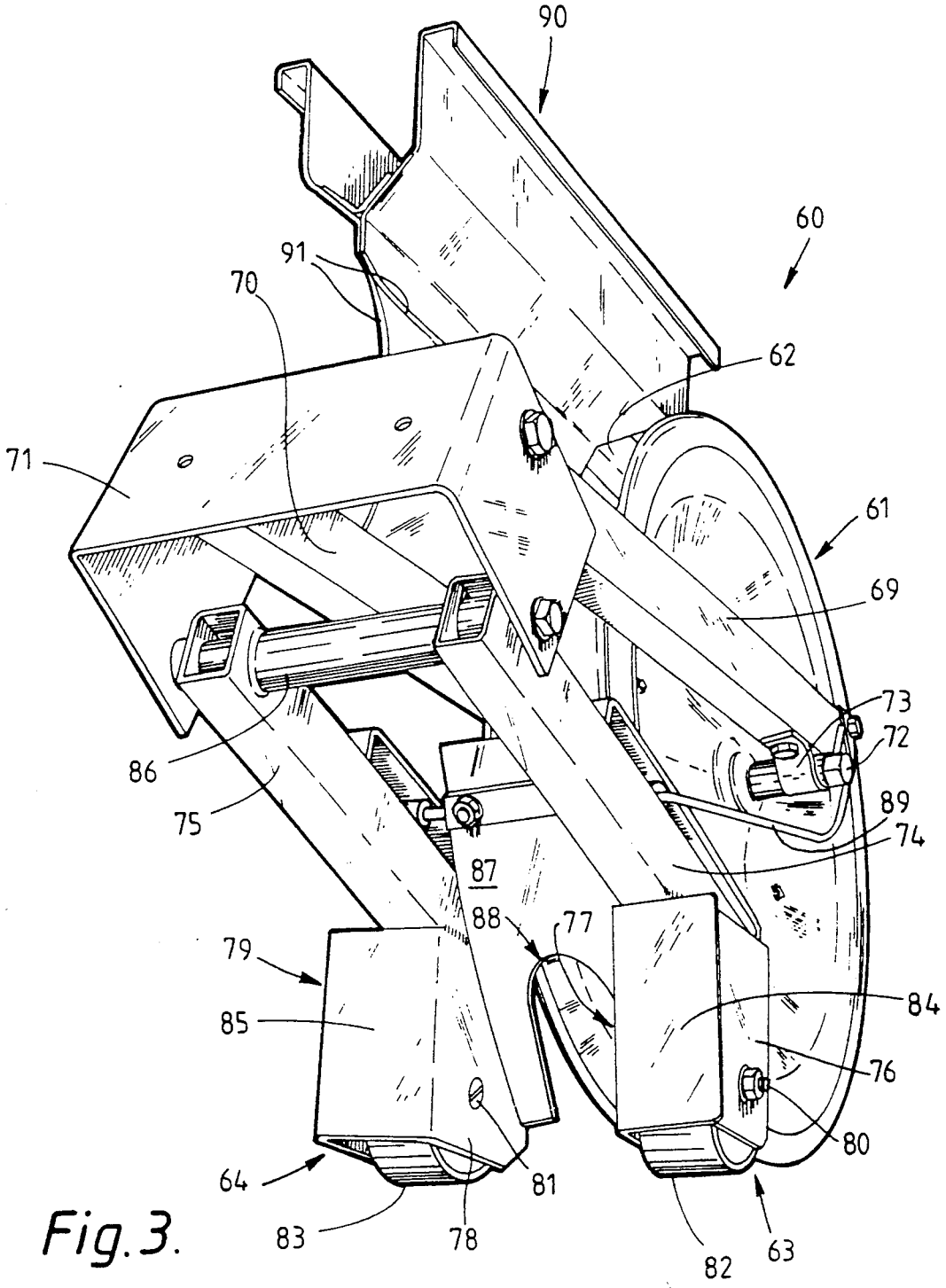
FIG. 3 is a forward view of a golf ball retrieving assembly according to a second embodiment of the invention.
Figure 4:
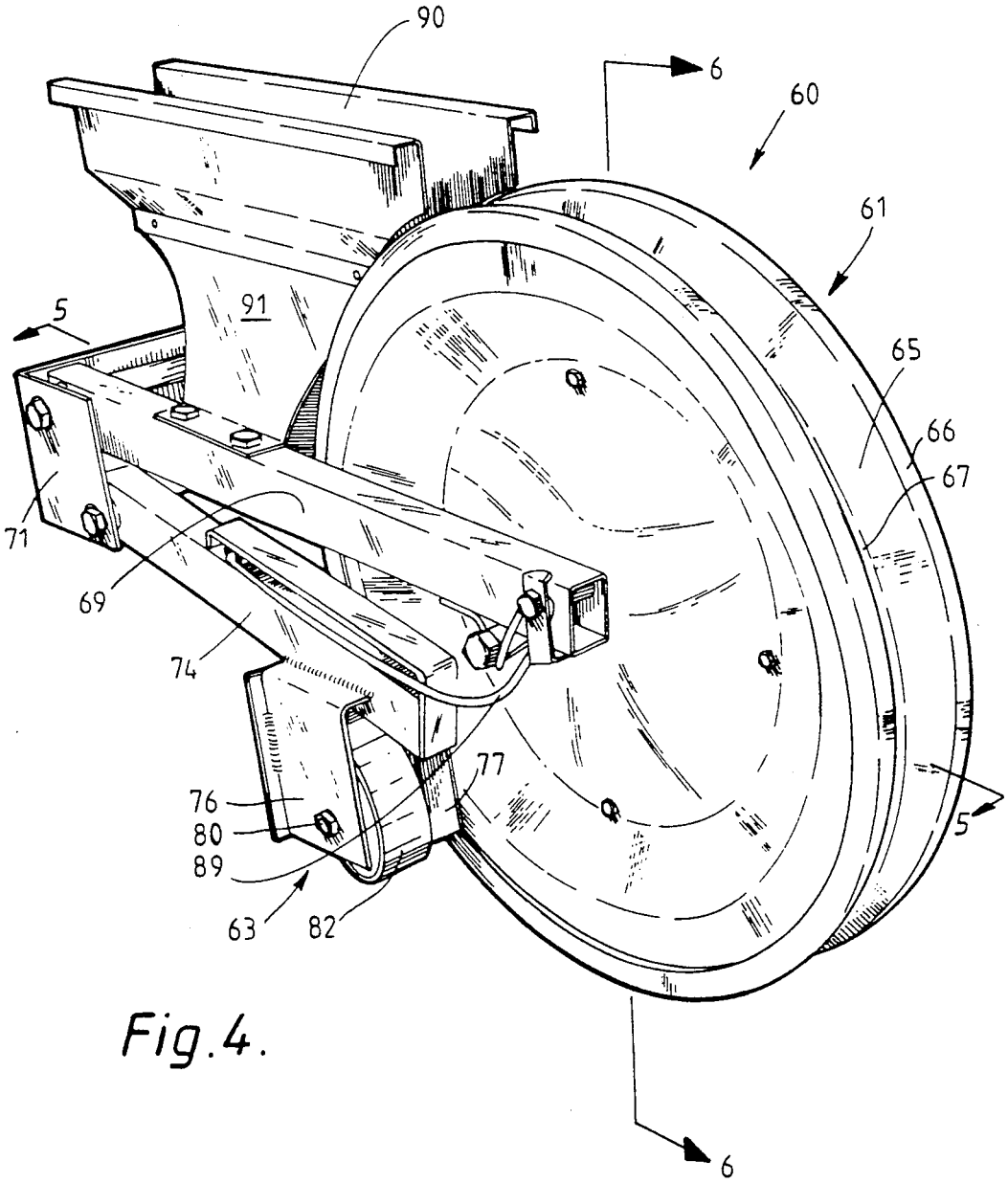
FIG. 4 is a rear view of the assembly of FIG. 3.

FIGS. 3 and 4 show a golf ball retrieving assembly according to a further embodiment of the invention.

Referring to FIGS. 3 and 4 there is again disclosed a golf ball retrieving assembly 60 comprising a ground engageable collector wheel 61, ball expelling means 62, and a pair of ball deflecting assemblies 63, 64.

Collector wheel 60 includes a peripheral channel 65 which is defined by side walls 66, 67 of collector wheel 61. In this embodiment, collector wheel 60 is of a three-part constructions being formed from two disc-like members bolted together to form side walls 66, 67. To grip golf balls in peripheral channel 65, a grip enhancing member in the form of a removable tire (see FIG. 6) is located within peripheral channel.

The wheel support arm comprises a pair of spaced arm members 69, 70. One end of each arm members 69, 70 is pivotally coupled to a support 71 while the other end of arm members 69, 70 supports a shaft 72 through a bracket 73. Collector wheel 61 is rotatably mounted about shaft 72. In this manner, collector wheel 61 is pivotally coupled to support 71 to enable it to track undulations in a ground surface. Support 71 can be mounted to a transversely extending support member (not shown).

Each of ball deflecting assemblies 63, 64 is secured to one end of a respective assembly support arm 74, 75. The ball deflecting assemblies comprise a pair of spaced side walls 76, 77, 78 and 79. A shaft 80, 81 extends between adjacent pairs of side walls 76, 77 and 78, 79. A ground engageable and transversible member in the form of a roller 82, 83 is rotatably mounted about each shaft 80, 81. Each ball deflecting assembly further includes a deflecting face 84, 85 which is inclined towards collector wheel 61 and extends from adjacent peripheral edges of the collector wheel.

The other end of each of assembly support arms 74, 75 is pivotally coupled to a transverse shaft 86 which is itself secured to support 71. In this manner, ball deflecting assemblies 63, 64 are pivotally mounted relative to support 71 to enable them to track a ground surface and are independently pivotally mountable relative to collector wheel 61. In this embodiment however ball assemblies 63, 64 are not independently pivotable relative to each other as is the case with the assembly of FIG. 1.

A guide plate 87 extends between deflecting assemblies 63, 64 and includes a golf ball receiving recess 88 to further assist in guiding golf balls to collector wheel 61.

Ball deflecting assemblies 63, 64 are biased into engagement with the ground surface through spring 89 which extends between a respective assembly support arm 74, 75 and a respective arm member 69, 70.

Figure 5:
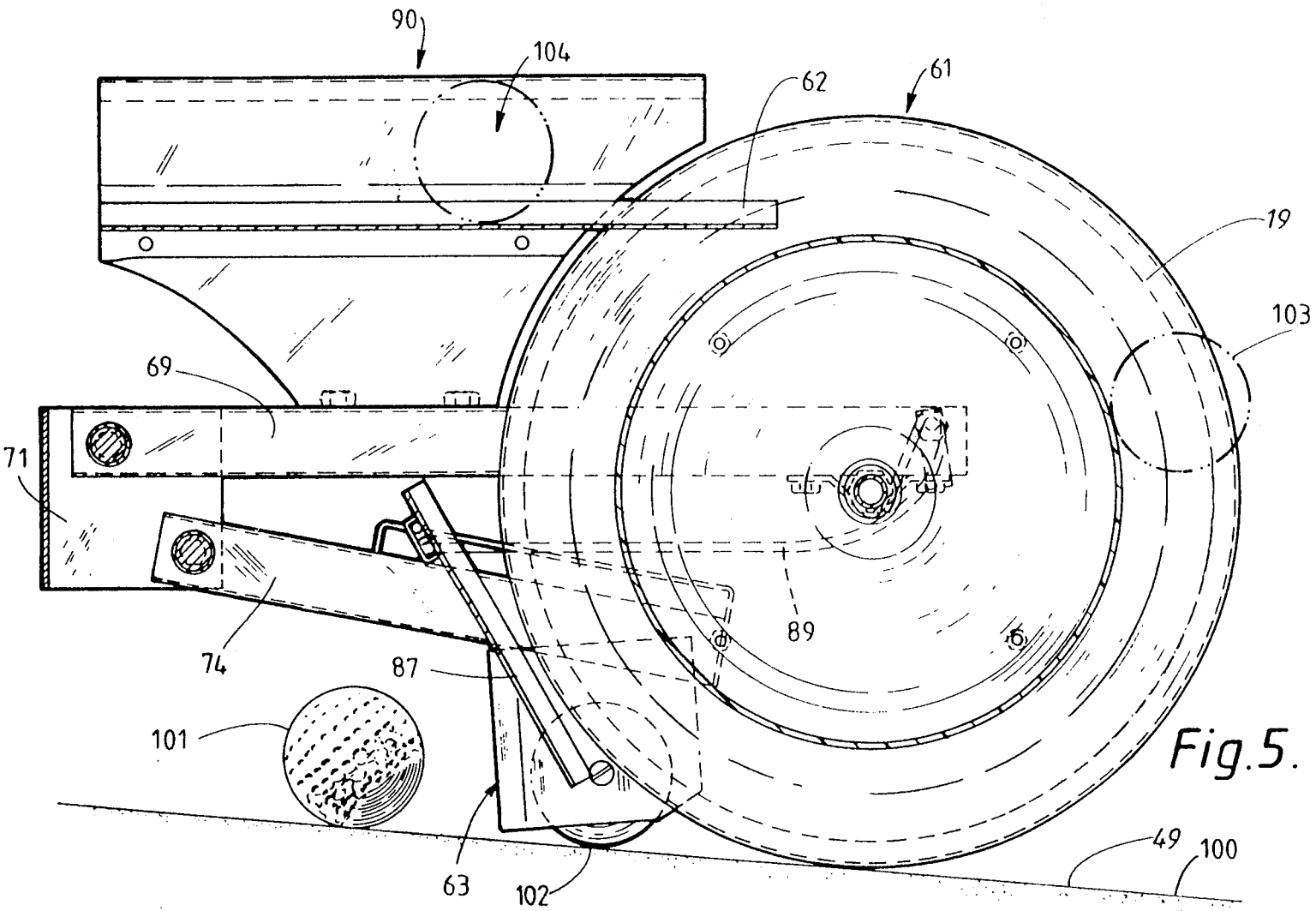
FIG. 5 is a view of the assembly of FIGS. 3 and 4 showing the action by which a golf ball is retrieved.

Ball expelling means 62 as with the embodiment of FIG. 1 comprises a finger which extends from a ball guide member 90. Ball guide member 90 again includes a channel section having lower web portions 91 which are secured to respective arm members 69, 70 to mount the ball guide member in position FIG. 5 shows the assembly of FIGS. 3 and 4 in use. As collector wheel 61 is towed over a ground surface 100 it encounters a golf ball 101. Golf ball 101 is either directly gripped within peripheral channel 65 or contacts a respective ball deflecting assembly 63 and is guided to collector wheel 61 (see golf ball 102). Upon further rotation of collector wheel 61 the golf ball is rotated with the collector wheel and will contact ball expelling means 62 whereupon the golf ball is removed from the channel and is propelled along ball guide member 90 (see golf ball 104). The golf ball will be propelled along ball guide member 90 by the forward velocity imparted to it upon being dislodged from collector wheel 61.

FIG. 5 also more clearly discloses how the ball deflecting assembly 63 and collector wheel 61 are independently pivotally mounted relative to each other.

Figure 6:
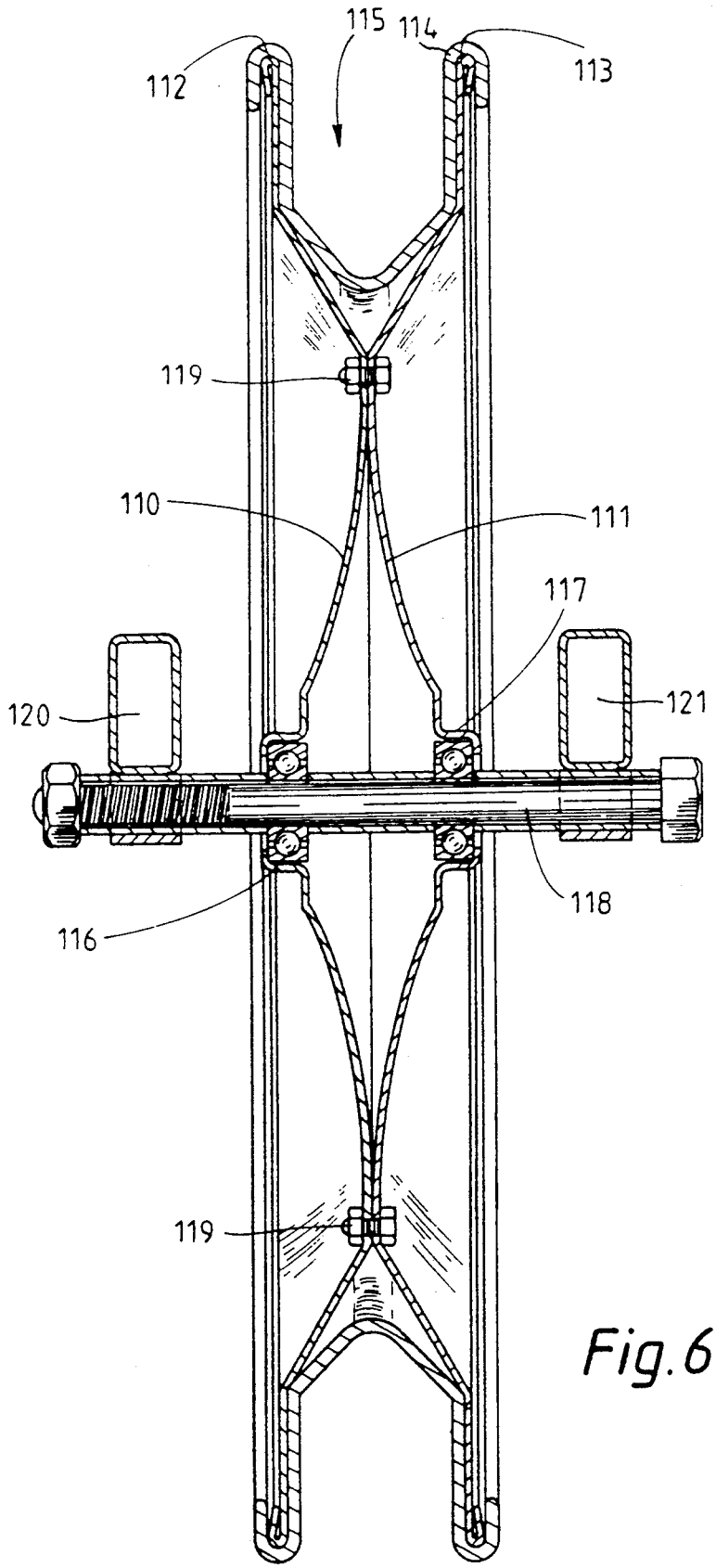
FIG. 6 is a cross-section view of a collector wheel of an embodiment of the invention.

FIG. 6 shows a cross-section view of the golf ball collector wheel of FIG. 3 and 4. Golf ball collector wheel is of a three-part construction. Two disc like members 110, 111 having spaced peripheral edges 112, 113 over which a removable tire 114 is mounted are assembled to form the collector wheel. Removable tire 114 is formed from resilient material and forms peripheral channel 115. The walls of peripheral channel 115 are inwardly convergent so golf balls wedge within the channel. Bearings 116 are housed within a hub 117 to allow the collector wheel to be rotatably mounted about shaft 118. The disc like members 110, 111 are secured together by spaced fastening bolts 119. In order to replace tire 114, shaft 118 is removed and bolts 110 are removed so that the disc like members can be pulled apart to replace the tire.

Shaft 118 is supported by the respective support arm members 120, 121 extending along each side of the collector wheel.

Figure 7:
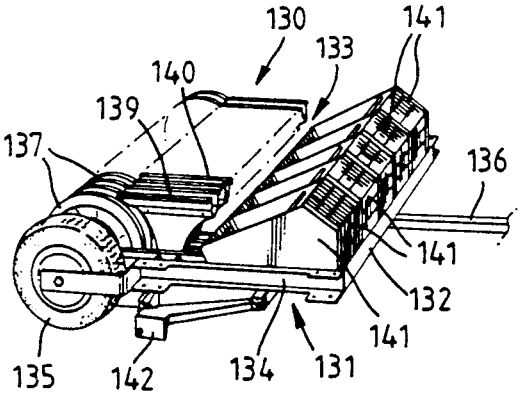
FIG. 7 is a view of a golf ball retriever having a main frame assembly and a number of golf ball retrieving assemblies located in a side by side relationship.

Referring to FIG. 7 there is disclosed a golf ball retriever 130 containing a plurality of golf retrieving assemblies as depicted in FIG. and 2. Retriever 130 comprises a main frame assembly 131 which comprises a forward transversely extending frame member 132 and a transversely extending support frame member 133 (not shown). Side frame members 134 couple transversely extending frame members 132 and 133 together. One end of side frame members 134 supports a ground engaging wheel 135 (the wheel on the other side not shown). Wheel 135 comprises a rubber pneumatic wheel to allow the main frame assembly to be supported from a ground surface. The retriever can be towed by a towing vehicle through connecting arm 136 which can be hitched to the vehicle.

A plurality of golf ball retrieving assemblies 137 are located in a side by side relationship and are pivotally coupled to transversely extending support frame member 133. Each golf ball retrieving assembly is of the type depicted in FIGS. 1 and 2. Respective ball guide members 139, 140 guide golf balls dislodged by the ball expelling means to collection basket 141. It will be seen that collecting basket 141 can be of sufficient size such that a number of respective ball guide members 139, 140 will exhaust golf balls into a single collecting basket.

A number of golf ball retrievers 130 can be coupled together in a side by side arrangement. For this reason, the retriever includes a main frame guide member 142 which is secured to frame member 34 to guide golf balls away from wheel 135 and to a respective golf ball retrieving assembly.

Figure 8:
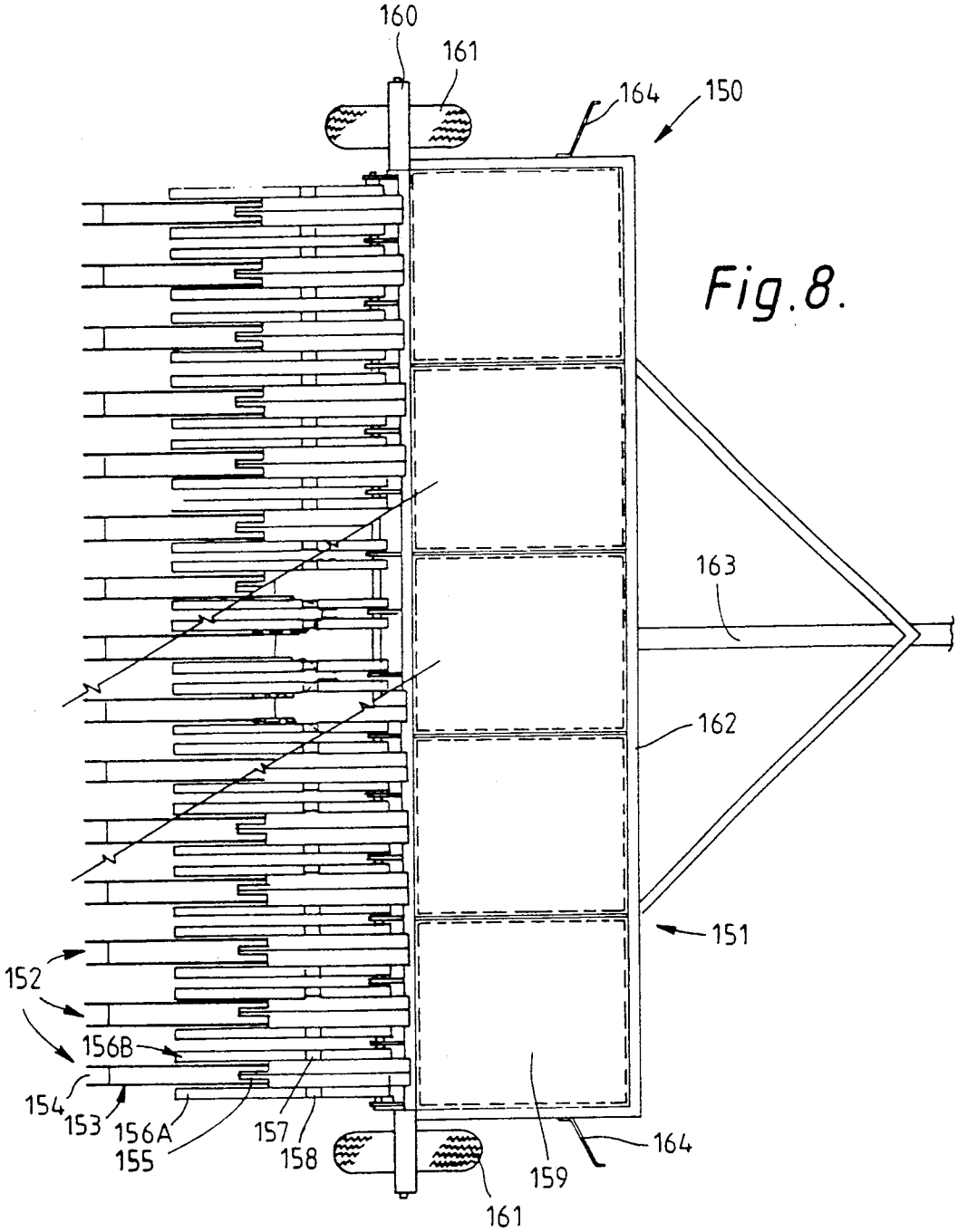
FIG. 8 is a plan view of a similar retriever to FIG. 7.

FIG. 8 is a plan view of a similar retriever as depicted in FIG. 7 except incorporating the golf ball receiving assemblies as depicted in FIGS. 3 and 4. Again, retriever 150 comprises a main frame assembly 151 and a plurality of golf retrieving assemblies 152 located in a side by side relationship. Each golf ball retrieving assembly comprises a collector wheel 153 (shown diagrammatically) having a peripheral channel 154 with a ball expelling means 155 located to remove balls from peripheral channel 154. Each collector wheel 153 is mounted about a shaft (not shown) extending between adjacent support arm members 155, 156A, 156B. A pair of ball deflecting assemblies 157, 158 guide golf balls to a respective collector wheel 153 in a manner described above. A ball guide member (not shown) guides a golf ball from ball expelling means 155 to a respective collection basket 159.

Each golf retrieving assembly is pivotally mounted to a common transversely extending support frame member 160 the ends of which also support ground engaging wheels 161.

The main frame assembly further includes a forward transversely extending frame member 162 and a draw bar 163. A secondary guide web 164 is located on the main frame assembly 151 to guide balls away from wheels 161 upon use of the retriever.

Figure 9:
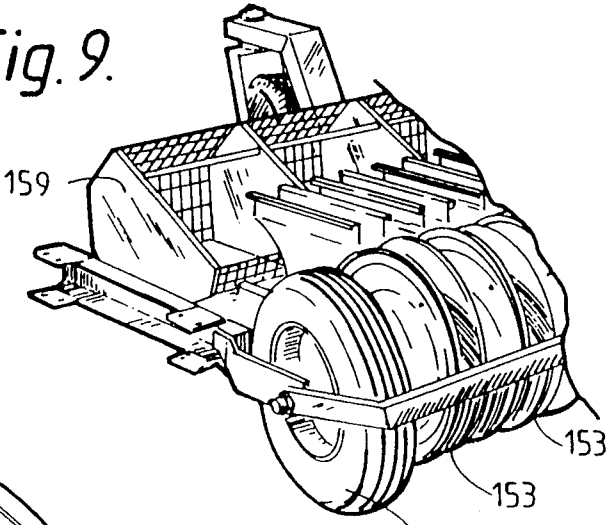
FIG. 9 is a cut-away view of a further preferred embodiment according to the invention.
Figure 10:
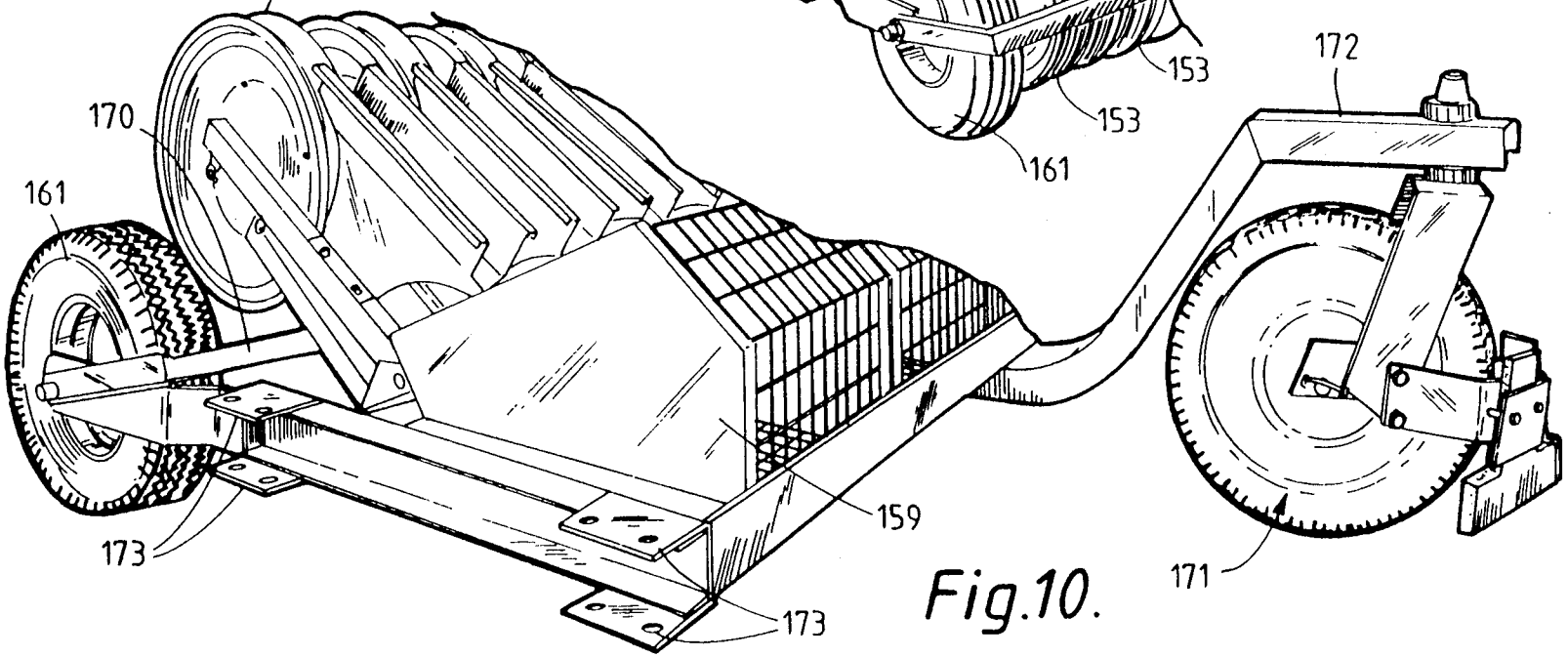
FIG. 10 is a out-away perspective view of a further preferred embodiment according to the invention.

FIGS. 9 and 10 show out-away perspective views of a further embodiment of the invention. The respective ends of the retriever are shown but it will be realised that a number of such retrievers can be end on in a cascade. FIG. 9 shows a retriever with collector wheels in a collecting position, while FIG. 10 shows the retriever with the collector wheels in a transport position. The collector wheels can be raised to the transport position and supported by a bar member 170 to allow ready transport of the retriever to and from the use area. The retriever also includes a forward castor type wheel 171 mounted to draw bar 172. FIGS. 9 and 10 also show suitable end brackets 173 to enable adjacent retrievers to be coupled together. A suitable linkage (not shown) can be employed between opposing sets of brackets 173 to allow adjacent retrievers to pivot relative to each other.

Thus, it can be seen that the golf ball retrieving assembly and a retriever containing a number of such assemblies in a side by side relationship allows extremely efficient collection of golf balls from a fairway by having both the collector wheel and each of the guide members being able to track a ground surface independently from each other.

It should be appreciated that various other changes and modifications can made to the embodiments described without departing from the spirit and scope of the invention as defined in the appended Claims.

We claim:

1. A golf ball retriever movable across a ground surface in a forward direction, said retriever comprising a transversely extending frame member; at least one ground engageable collector wheel having a recess to accept and retain golf balls therein, said collector wheel being rotatably mounted to a wheel support arm, and said wheel support arm being mounted to said transversely extending frame member for movement in a vertical plane relative to said transversely extending frame member, thereby allowing the collector wheel to track undulations in the ground surface upon movement of the retriever in the forward direction; at least one ball deflecting assembly located adjacent said collector wheel and having an assembly support arm, said assembly support arm being mounted to said transversely extending frame member for movement of said ball deflecting assembly in a vertical plane relative to said transversely extending frame member and said collector wheel, thereby allowing said ball deflecting assembly to track undulations in the ground surface while said collector wheel independently tracks undulations in the ground surface upon movement of the retriever in the forward direction, said ball deflecting assembly including a deflecting face located forward of said collector wheel to guide golf balls to said recess in said collector wheel, a ball expelling means to remove golf balls from said recess in said collector wheel, and a ground engageable and transversable member to support said ball deflecting assembly on the ground surface and to allow said ball deflecting assembly to move along the ground surface.

2. A retriever as set forth in claim 1, wherein said assembly support arm is mounted to said transversely extending frame member independently of said collector wheel for movement in a vertical plane.

3. A retriever as set forth in claim 1, wherein said wheel support arm is pivotally mounted to said transversely extending frame member.

4. A retriever as set forth in claim 3, wherein said assembly support arm is pivotally mounted to said transversely extending frame member.

5. A retriever as set forth in claim 4, wherein said ground engageable and transversable member of said ball deflecting assembly is a wheel.

6. A retriever as set forth in claim 5, wherein said ball deflecting assembly comprises a body portion, said body portion having a side wall extending in line with a side wall of said collector wheel, and a shaft supported by said side wall of said body portion, said wheel of said ball deflecting assembly being rotatably mounted about said shaft, and said deflecting face being formed by a forward part of said body portion.

7. A retriever as set forth in claim 6, wherein said at least one ground engageable collector wheel comprises a pair of said collector wheels rotatably mounted to respective wheel support arms that are mounted to said transversely extending frame member for movement in a vertical plane independently of one another, and said ball deflecting assembly is disposed between said collector wheels of said pair, said deflecting face of said ball deflecting assembly being of a generally arrow head configuration and having a first inclined portion extending forwardly and outwardly from the recess in one collector wheel of said pair to guide golf balls to the recess in said one collector wheel, and a second inclined portion extending forwardly and outwardly from the recess in the other collector wheel of said pair to guide golf balls to the recess of said other collector wheel.

8. A retriever as set forth in claim 7, wherein said ball deflecting assembly is biased into engagement with the ground surface.

9. A retriever as set forth in claim 7, wherein said at least one ball deflecting assembly includes a pair of transversely spaced ball deflecting assemblies disposed adjacent respective sides of said collector wheel.

10. A retriever as set forth in claim 6, wherein said deflecting face includes a pair of oppositely inclined portions disposed on respective sides of said collector wheel for guiding golf balls toward the recess in said collector wheel, and said oppositely inclined portions are interconnected by a guide plate to facilitate guiding of golf balls to said collector wheel.

11. A retriever as set forth in claim 4, wherein said recess in said collector wheel comprises an endless peripheral channel to accept and retain golf balls therein.

12. A retriever as set forth in claim 11, wherein said peripheral channel is defined by a pair of spaced side walls, at least one of said side walls being resiliently deformable to allow golf balls to be accepted and retained within said channel.

13. A retriever as set forth in claim 12, wherein both of said side walls are resilient deformable.

14. A retriever as set forth in claim 13, wherein said collector wheel is formed from plastic material.

15. A retriever as set forth in claim 11, wherein said ball expelling means comprises a finger extending into said recess of said collector wheel to dislodge golf balls therefrom.

16. A retriever as set forth in claim 15, wherein said finger extends from ball guide, said ball guide guiding golf balls to a collecting area.

17. A retriever as set forth in claim 16, wherein said ball guide comprises a generally U-shape section secured to said wheel support arm.

18. A retriever as set forth in claim 1, wherein said at least one ground engageable collector wheel includes a plurality of said collector wheels arranged in side-by-side relationship and each mounted by respective wheel support arms to said transversely extending frame member for movement in a vertical plane independently of one another, and said at least one ball deflecting assembly includes a plurality of said ball deflecting assemblies located adjacent respective said collector wheels, said ball deflecting assemblies having the assembly support arms thereof mounted to said transversely extending frame member for movement in a vertical plane relative to one another and to said collector wheels.

19. A retriever as set forth in claim 18, wherein said collector wheels and ball deflecting assemblies are transversely positioned relative to each other such that the spacing between adjacent collector wheels corresponds to the width of a respective ball deflecting assembly.

20. A retriever as set forth in claim 18, wherein each said collector wheel is disposed between a respective pair of said ball deflecting assemblies.

21. A retriever as set forth in claim 18, comprising a main frame assembly including said transversely extending frame member, said main frame assembly having ground engaging wheels for supporting said main frame assembly on the ground surface and for permitting towing of said main frame assembly by a vehicle in the forward direction.

22. A retriever as set forth in claim 21, wherein said main frame assembly includes a forward transversely extending frame member spaced forwardly from the transversely extending frame member, and a plurality of golf ball collecting areas are provided between said frame members.

23. A retriever as set forth in claim 22, wherein said golf ball collecting areas are comprised of collecting baskets to collect golf balls dislodged from said collector wheels.

24. A retriever as set forth in claim 21, wherein said collector wheels and ball deflecting assemblies are supportable in a transport position where each of the collector wheels and assemblies are spaced above the ground surface.

25. A retriever as set forth in claim 24, wherein said collector wheels and ball deflecting assemblies are support in the transport position by a bar member extending below and at least support each wheel support arm.

* * * * *